US010471567B2

(12) United States Patent
Doering et al.

(10) Patent No.: US 10,471,567 B2
(45) Date of Patent: Nov. 12, 2019

(54) CMP PAD CONDITIONING ASSEMBLY

(71) Applicant: Entegris, Inc., Billerica, MA (US)

(72) Inventors: Patrick Doering, Holliston, MA (US); Rajesh Tiwari, Chelmsford, MA (US); Andrew Galpin, Westford, MA (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

(21) Appl. No.: 15/266,696

(22) Filed: Sep. 15, 2016

(65) Prior Publication Data

US 2018/0071891 A1 Mar. 15, 2018

(51) Int. Cl.

| | |
|---|---|
| ***B24B 37/04*** | (2012.01) |
| ***B24B 53/017*** | (2012.01) |
| ***B24B 53/12*** | (2006.01) |
| ***B24D 7/04*** | (2006.01) |
| ***B24B 37/20*** | (2012.01) |
| ***B24B 37/34*** | (2012.01) |
| ***B24D 7/08*** | (2006.01) |

(52) U.S. Cl.

CPC ..... *B24B 53/017* (2013.01); *B24B 37/04* (2013.01); *B24B 37/20* (2013.01); *B24B 37/34* (2013.01); *B24B 53/12* (2013.01); *B24D 7/04* (2013.01); *B24D 7/08* (2013.01)

(58) Field of Classification Search

CPC ..... B24B 37/04; B24B 37/20; B24B 53/017; B24B 53/12; B24D 7/04

USPC ..... 451/443, 56

See application file for complete search history.

(56) References Cited

U.S. PATENT DOCUMENTS

| | | | | |
|---|---|---|---|---|
| 5,190,568 | A * | 3/1993 | Tselesin | B23D 61/021 51/293 |
| 5,197,249 | A * | 3/1993 | Wiand | B24D 7/06 451/529 |
| 5,297,364 | A * | 3/1994 | Tuttle | B24B 7/228 451/527 |
| 6,196,911 | B1 | 3/2001 | Preston et al. | |
| 6,213,856 | B1 * | 4/2001 | Cho | B24B 53/017 451/443 |
| 7,066,795 | B2 * | 6/2006 | Balagani | B24B 53/017 451/285 |
| 7,201,645 | B2 * | 4/2007 | Sung | B24B 53/017 451/443 |

(Continued)

FOREIGN PATENT DOCUMENTS

| | | |
|---|---|---|
| EP | 1 292 428 B1 | 4/2005 |
| JP | 10-34519 A | 2/1998 |

(Continued)

*Primary Examiner* — Eileen P Morgan

(74) *Attorney, Agent, or Firm* — Entegris, Inc.

(57) ABSTRACT

A chemical mechanical planarization (CMP) pad conditioning assembly that includes one or more support structures positioned between one or more abrasive regions of the pad conditioning assembly is disclosed. The support structures and abrasive regions can be separated by one or more channels. A top surface of the one or more support structures is not co-planar with the top surface of the abrasive regions of the pad conditioning assembly, and the height of the top surface of the one or more support structures when measured to the pad facing surface of the pad conditioning assembly backing plate is less than the height of the top surfaces of the abrasive regions when measured to the pad facing surface of the pad conditioning assembly.

13 Claims, 6 Drawing Sheets

(56) References Cited

U.S. PATENT DOCUMENTS 7,815,495 B2 * 10/2010 Xu ..... B24B 29/005 451/443
8,393,934 B2 * 3/2013 Sung ..... B24D 3/007 451/443
8,398,466 B2 * 3/2013 Sung ..... B24B 53/017 451/443
9,067,302 B2 * 6/2015 Chou ..... B24B 53/017
2004/0048557 A1 * 3/2004 Nabeya ..... B24B 53/017 451/56
2006/0079160 A1 * 4/2006 Balagani ..... B24B 53/017 451/285
2008/0254722 A1 * 10/2008 Xu ..... B24B 29/005 451/444
2011/0275288 A1 * 11/2011 Sung ..... B24B 53/017 451/56
2014/0099868 A1 * 4/2014 Sung ..... B24B 53/017 451/56
2014/0113532 A1 * 4/2014 Smith ..... B24B 53/017 451/443
2014/0273773 A1 * 9/2014 Chou ..... B24B 53/017 451/443
2014/0302756 A1 * 10/2014 Sung ..... B24B 53/017 451/443
2015/0017884 A1 * 1/2015 Sung ..... B24B 53/017 451/56
2015/0290768 A1 * 10/2015 Chou ..... B24B 53/017 451/443
2016/0236320 A1 * 8/2016 Chou ..... B24B 53/017
2017/0232576 A1 * 8/2017 Sung ..... B24B 53/017 451/56

FOREIGN PATENT DOCUMENTS

TW M423908 U 3/2012
WO 2012/122186 A4 1/2013
WO 2015/143278 A1 9/2015
WO 2016/181751 A1 11/2016

* cited by examiner

CMP PAD CONDITIONING ASSEMBLY

FIELD

The present disclosure relates to chemical mechanical polishing pad conditioners.

DESCRIPTION OF RELATED ART

During the microelectronic device fabrication process, multiple integrated circuits are formed upon the surface of substrate. Examples of substrates include silicon wafers, gallium arsenide wafers, and the like. Each integrated circuit consists of microelectronic devices electrically interconnected with conductive traces known as interconnects. Interconnects are patterned from conductive layers formed on the surface of the substrate. The ability to form stacked layers of interconnects has allowed for more complex microelectronic circuits to be implemented in and on relatively small surface areas of the substrate. With the number of microelectronic circuits increasing and becoming more complex, the number of layers of a substrate are increasing. Accordingly, planarity of the substrate surface becomes an important aspect in semiconductor manufacturing.

Chemical mechanical polishing (CMP) is a method of planarizing the surface of a layer of a substrate. CMP combines chemical etching and mechanical abrasion to remove material from the surface of the substrate. During the CMP process, the substrate is attached to the head of a polishing tool and is inverted such that the integrated circuit-embodied surface opposably faces a polishing pad. A slurry containing abrasive particles and a chemical etchant is deposited onto the rotating polishing pad. The chemicals can soften or react with the exposed surface material on the substrate that is being planarized. The polishing pad is fixedly attached to a turntable or platen. The substrate is polished by placing the rotating substrate into contact with the polishing pad while the polishing pad is rotated on the platen. The surface of the integrated circuit-embedded surface of the substrate can be removed by the combined action of chemical softening of the exposed surface material and physical abrasion brought about by relative movement between the polishing pad, the slurry and the substrate.

As portions of the substrate are removed by the polishing pad, a combination of slurry and debris tends to clog and glaze the surface of the polishing pad, such that over time, the polishing pad becomes less effective at removing material from the substrate. The surface of the polishing pad is cleaned or conditioned by a CMP pad conditioning assembly, which has an abrasive surface that engages the polishing pad surface. Known CMP pad conditioning assemblies can have an abrasive surface that includes protrusions, mesas, or cutting edges and these may be coated with hard coatings like cubic boron nitride, diamond grit, or polycrystalline diamond. The abrasive surface of the pad conditioning assembly can itself become worn thereby rendering it less and less effective over time for reconditioning the CMP polishing pad. During conditioning of the CMP polishing pad, the pad conditioning assembly abrades the CMP pad and opens new pores and fresh pad surface for polishing.

The CMP process utilizes many consumables including the slurry and chemicals, the polishing pad, and the pad conditioning assembly. Replacing consumables can be time consuming and result in lost manufacturing yield and reduced wafer throughput. Some CMP processes require pad conditioning over the entire pad surface (no edge exclusion). Maintaining the co-planarity of a pad conditioning assembly with the polishing pad during this operation when the conditioning disk sweep recipe extends the pad conditioning assembly beyond the outer diameter of the polishing pad can be difficult and can result in damage or excess wear to the pad. For example, segmented conditioning disk designs can tilt once the conditioning disk extends beyond the outer diameter of the pad. This can result in non-uniform/excess pad wear at the perimeter of the pad and may even result in tearing of the pad.

In an effort to reduce consumable costs and reduce polishing tool downtime, semiconductor manufactures have begun utilizing the outer edges of the CMP polishing pad. Accordingly there is a continuing need for CMP pad conditioning assemblies that can condition CMP pads including the outer edges of the CMP pad.

SUMMARY

The problem of pad conditioning assemblies causing excessive wear on a CMP pad during pad conditioning can be reduced or eliminated by a CMP pad conditioning assembly that includes a backing plate that has abrasive regions separated from one or more supporting structures by one or more channels. The CMP pad conditioning assembly includes a backing plate has a first face and a second face. The backing plate includes a mounting structure that can attach the backing plate of the conditioning assembly to a chemical mechanical planarization tool. The pad conditioning assembly further includes a plurality of abrasive regions on a first face of the backing plate, the abrasive regions can comprise one or more protrusions or cutting edges. A top of the protrusions or cutting edges reside in a first plane that has a first average height that can be measured from the first face of the backing plate. The CMP pad conditioning assembly also has one or more supporting structures that are on or fixed to the backing plate. The one or more supporting structures can be positioned between, and can be separated from, the abrasive regions by one or more channels. The one or more supporting structures can have a top surface, a bottom surface, and a thickness measured between the top and bottom surface. The top surface of the one or more supporting structures resides in a second plane that has a second average height that can be measured from the first face of the backing plate. The height of the tops of the protrusions or cutting edges of the first plane is greater than the height of the top surface of the second plane of the supporting structure(s).

In some versions of the CMP pad conditioner assembly, the first average height of the first plane is greater than the second average height of the second plane by between 25 microns and 200 microns. In other versions of the CMP pad conditioned assembly, the first average height of the first plane is greater than the second average height of the second plane by between 50 microns and 100 microns.

In some versions of the pad conditioning assembly the abrasive regions are equally spaced or essentially equally spaced about the backing plate and separated by channels from the one or more supporting structures positioned between the abrasive regions.

In some versions of the pad conditioning assembly, a coating of polycrystalline diamond and/or diamond grit can be deposited on all or a portion of the abrasive regions.

In some versions of the pad conditioning assembly, the abrasive regions can be segments fixed to the backing plate while in some other versions the abrasive regions can be formed integrally with the backing plate. A combination of fixed and integral abrasive regions can also be used.

In other versions of the CMP pad conditioning assembly, the assembly includes a backing plate that has a first face and a second face, the backing plate includes a mounting structure and the mounting structure can be used to secure the conditioning assembly to a chemical mechanical planarization tool. The conditioning assembly includes one or more abrasive regions on the first face of the backing plate that can have an abrasive coating and/or one or more protrusions. The abrasive coating or tops of the protrusions when present, can reside in a first plane that has a first average height measured from the first face of the backing plate. The one or more supporting structures on the first face of the backing plate can be positioned between the abrasive regions and may be separated from the abrasive regions. The one or more supporting structures have a top surface, the top surface of the one or more supporting structures reside in a second plane that has a second average height measured from the first face of the backing plate, the first average height of the first plane is greater than the second average height of the second plane. The one or more supporting structures can include one or more channels in a surface and/or can form channels with one or more abrasive regions.

The pad conditioning assembly in some versions can have one or more channels comprising the supporting structures, the channels formed between the one or more abrasive regions and the one or more supporting structures. The channels can have parallel or non-parallel side walls.

The pad conditioning assembly can include versions in which the support structure is a single piece. The support structure can be a polymeric material.

BRIEF DESCRIPTION OF THE DRAWINGS

FIG. 7 further illustrates that the abrasive regions are not separated from the support by channels and the support structure has channels in the top surface.

DETAILED DESCRIPTION

Figure 1A:
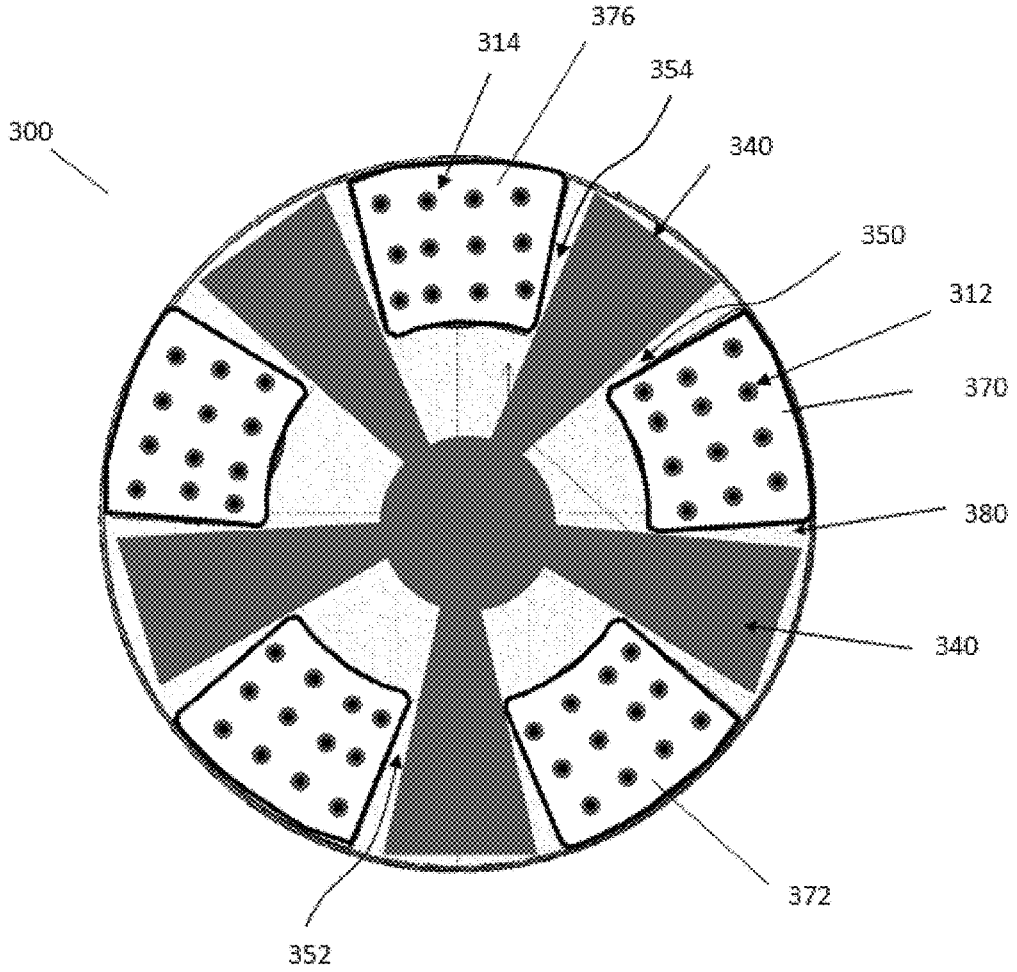
FIG. 1A is an illustration of a top view of a chemical mechanical planarization (CMP) pad conditioning assembly that has a single support structure and multiple abrasive regions or abrasive segments.

As illustrated with reference to FIG. 1A, FIG. 1B, FIG. 2A, FIG. 2B and FIG. 3, a CMP pad conditioning assembly 300 can include a backing plate 380 that has a first face 384 and a second face 386. The backing plate can include one or more mounting structures 336 and 338 that secures or can be used to fix the backing plate of the conditioning assembly to a chemical mechanical planarization tool. The pad conditioning assembly 300 further includes a plurality of abrasive regions 370, 372, and 376 atop the first face 384 of the backing plate 380. The abrasive regions can comprise one or more protrusions or cutting edges 312 and 314. A top of the protrusions or cutting edges can be characterized as residing in a first plane 316 that has a first average height, for example the difference between 316 and 384, and the first average height can be measured from the first face 384 of the backing plate 380. One or more supporting structures 340 and 342 can be fixed to the backing plate, the one or more supporting structure(s) 340 can be positioned between, and can be separated from, the abrasive regions like 370 and 376 by one or more channels 350 and 354. The one or more supporting structures 340 have a top surface 344, a bottom surface 346, and a thickness measured between the top and bottom surface. In the portion of the pad conditioning assembly illustrated in FIG. 3, the top surface 344 of the one or more supporting structures 340 resides in a second plane that has a second average height, for example the difference between 344 and 384, and the second average height can be measured from the first face 384 of the backing plate 380. In the pad conditioning assembly, the first average height of the protrusions or cutting edges is greater than the second average height of the top surface of the support structure.

In some versions of the pad conditioning assembly, the abrasive regions are equally spaced or essentially equally spaced about the backing plate and the one or more supporting structures are positioned between the abrasive regions.

In some versions of the pad conditioning assembly, a coating of polycrystalline diamond and/or diamond grit can be deposited on a portion of the abrasive regions and the support structures are free of a coating of polycrystalline diamond and/or diamond grit.

The plurality of abrasive segments can be spaced about the pad and collectively form a co-planar abrasive surface that has an average height above the top surface of the supporting structure(s) fixed to the backing plate.

In some versions of the CMP pad conditioning assembly, a plurality of non-abrasive supporting structures can be spaced between the abrasive regions with channels separating the supporting structures and the abrasive regions. In other versions, the supporting structure can be a single unitary piece fixed to the backing plate. The supporting structures can have a thickness and include a top surface that is parallel, but not co-planar, with the average height of the top of the abrasive regions.

Because the supporting structure(s) are lower in height than the average height of the tops of the abrasive regions, the supporting structures have reduced load or in some versions are not load bearing during the pad conditioning process. CMP pad debris from the reconditioning of the pad as well as slurry and liquid can flow between the polishing pad and the top surface of the support structure so that pad debris, slurry and liquid can be removed from the CMP pad. The one or more channels between the abrasive regions and the supporting structures also aid in the removal of pad debris, slurry, and liquid.

Figure 6:
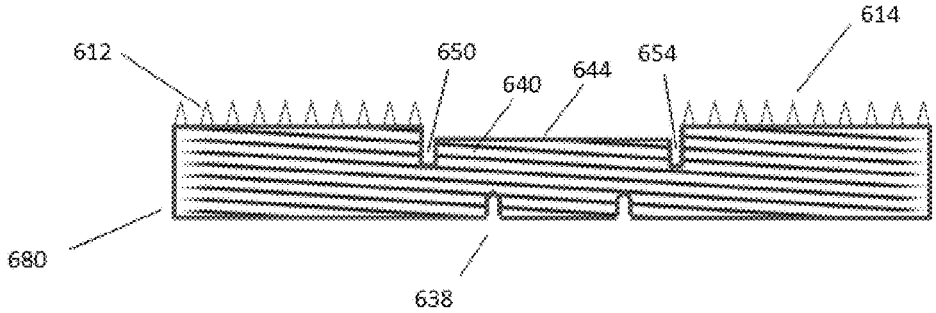
FIG. 6 is an illustration of a CMP pad conditioning assembly that has a monolithic structure with supporting region(s) separated from abrasive regions by one or more channels.

Pad conditioning assemblies can include abrasive regions or abrasive segments that are affixed to an underlying backing plate or formed integrally with the backing plate. The term abrasive region includes abrasive segments and combinations of abrasive regions and abrasive segments. The abrasive regions can have one or more protrusions or a cutting edges, and in some versions the protrusions or cutting edges can be of two or more different average heights. The abrasive regions or abrasive segments in some versions of the CMP pad conditioning assembly can be bonded or fixed to the backing plate using an adhesive such as an epoxy or mechanical devices such as bolts. The backing plate can be attached to the CMP polishing tool. Examples of pad conditioner assemblies including separate backing plate and conditioning segments are disclosed in PCT Pub. No.: WO/2012/122186 (International Application No.: PCT/US2012/027916). In some versions the pad conditioning assemblies can have integral abrasive regions with features like protrusions or a cutting edges formed or machined into the backing plate as illustrated in FIG. 6.

A plurality of protrusions on the abrasive regions can include but are not limited to those that have a geometrical cross section or those that are irregularly shaped as disclosed in Patent Cooperation Treaty Publication. No.: WO/2012/122186. For example, the protrusion may approximate a pyramid, an elongated cylinder, various needle shapes with a blunted or tapered point, or other suitable shape for conditioning a CMP pad. Protrusions can also refer to cutting edges which are elongated or blade like structures as disclosed in Patent Cooperation Treaty Publication. No. WO/2015/143278 A1. The abrasive region or segment can include a plurality of elongated protrusions that protrude in a forward direction that is normal to the pad contacting face of the abrasive region. Each elongated protrusion includes a base that defines a width and a length, the length being greater than the width and defining an elongate axis of the elongated protrusion. Each elongated protrusion further defines at least one ridge line that is elongated and in substantial alignment with the length. Accordingly, each ridge line is elongate in the direction of the elongate axis. In various embodiments, a ratio of the base length to the base width is in the range of 2 to 20 inclusive. A non-limiting example of the dimensions of the base width and the base length is 150 μηm and 500 μηm respectively. Combinations of protrusions and cutting edges can also be used in the abrasive regions or abrasive segments of the pad conditioning assemblies. The protrusions or cutting edges have a height above the top surface 374 of the abrasive region. In some versions this height can range from about 50 microns to about 200 micron. The density of protrusions or cutting edges in the abrasive regions can vary. In some versions the density of protrusions or cutting edges is about 2 to about 6 per square millimeter of abrasive region. In some pad conditioning assemblies, the abrasive regions or abrasive segments are absent protrusions and instead can have diamond grit or other hard ceramic bonded or brazed to the abrasive region.

A coating of polycrystalline diamond or other hard ceramic like polycrystalline cubic boron nitride can cover at least the distal extremities of the protrusions or cutting edges. Diamond grit or other hard ceramic grit like cubic boron nitride grit can also coat a portion of the protrusions or cutting edges. A combination of diamond grit or other hard ceramic and a coating of polycrystalline diamond or coating other hard ceramic like polycrystalline cubic boron nitride can be used to coat a portion of all of the protrusions or cutting edges. The hard coating may be atop the abrasive region or protrusions.

The pad conditioner assembly includes a supporting structure or one or more supporting structures that stabilizes the pad conditioning assembly during use along the outside edge of a CMP pad polishing pad. The supporting structure can be made of a material that is chemically compatible with the chemical mechanical planarization process chemicals and slurry. The material can be a plastic or polymer and can include polymer composites. One example of a polymer that can be used for the support structure is chlorinated polyvinyl chloride that has a chlorine content above 57% by weight to as high as 70% by weight. In some versions of the CMP pad conditioning assembly the support structure is made of a chlorinated polyvinyl chloride with a chlorine content of 62% by weight to 69% by weight.

The supporting structure has a top surface and a bottom surface. The bottom surface is fixed to the pad conditioner backing plate. The top surface of the supporting structure is closest to the CMP pad during use of the pad conditioner. The bottom surface of the supporting structure can be fixed to the pad conditioner backing plate by mechanical bolts or by using an adhesive. The support structure can be free of a hard coating on its top surface.

The height of the top surface of the supporting structure measured from the top surface of the backing plate (the surface to which the bottom surface of the supporting structure is fixed) is less than the height of the the tops of the protrusions or cutting edges measured to the backing plate surface. The difference in height between the tops of the protrusions or cutting edges and the top of the support structure can be measured by placing a flat substrate across the protrusions or cutting edges and determining an average distance to the top surface of the support structure.

FIG. 1A is an illustration of a top view of a chemical mechanical planarization (CMP) pad conditioning assembly 300 that has a single support structure 340 and multiple abrasive regions such as 370 and 372, the abrasive regions are fixed to a backing plate 380. Each of the abrasive regions includes raised features called protrusions, cutting regions or mesas 312 and 314 that are used to condition or abrade the CMP pad during conditioning. Channels such as 350, 352, and 354 can be located between the supporting structure(s) 340 and allow for the flow and movement of CMP pad debris, CMP slurry, and liquid away from the pad conditioning assembly 300 and the CMP pad. The channels such as 350, 352, and 354 are shown as having non-parallel side walls that diverge in width from an inside diameter of the backing plate towards the outer diameter of the backing plate.

Figure 1B:
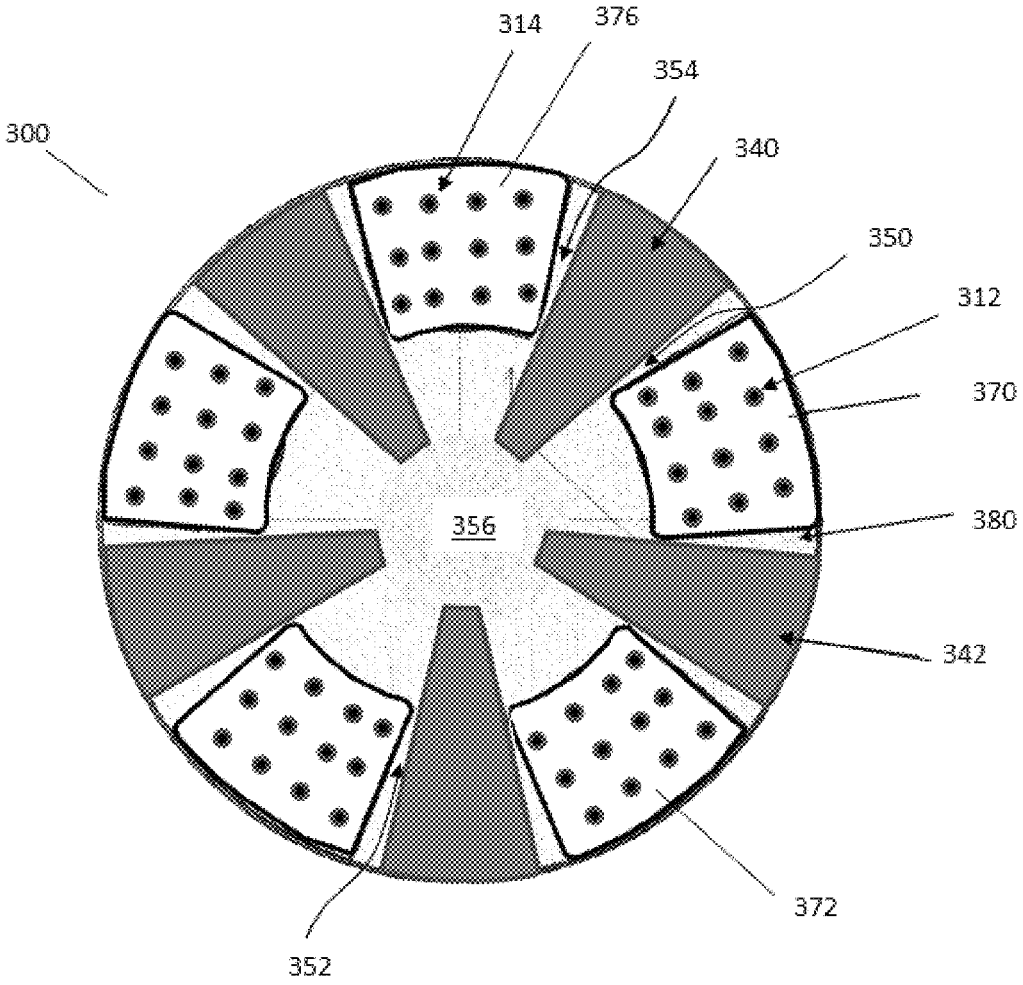
FIG. 1B is an illustration of a top view of a CMP pad conditioning assembly that has multiple support structures and multiple abrasive regions or abrasive segments.

FIG. 1B is an illustration of a top view of a CMP pad conditioning assembly that has multiple support structures such as 340, and 342, fixed to backing plate 380 and multiple abrasive regions such as 370 and 372 also fixed to the backing plate 380. One or more channels such as 350, 352, and 354 can be located between the support structure and the abrasive regions. FIG. 1B illustrates an open central region 356 whose size can vary and may be partially or completely filled with a supporting structure (not shown).

Figure 2A:
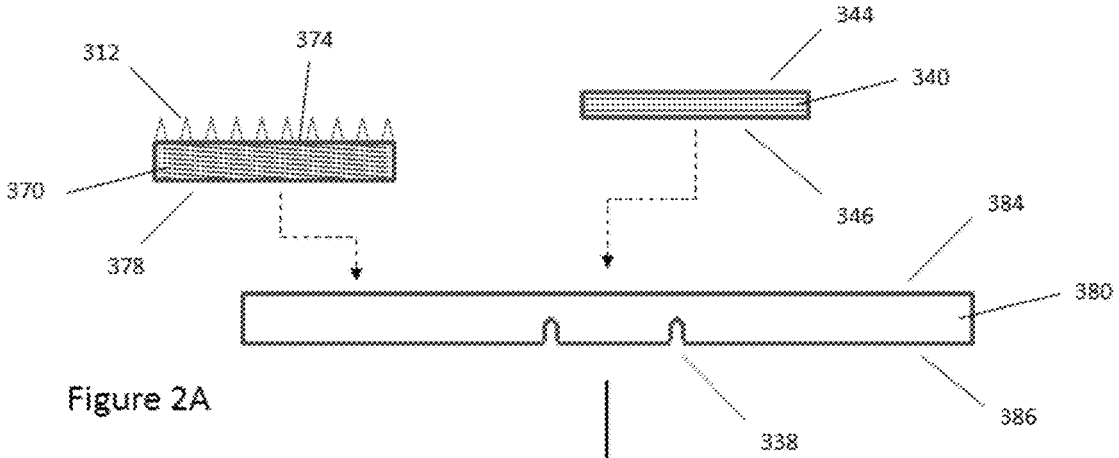
FIG. 2A is an illustration of the process of making a portion of a CMP pad conditioning assembly (cross section)
Figure 2B:
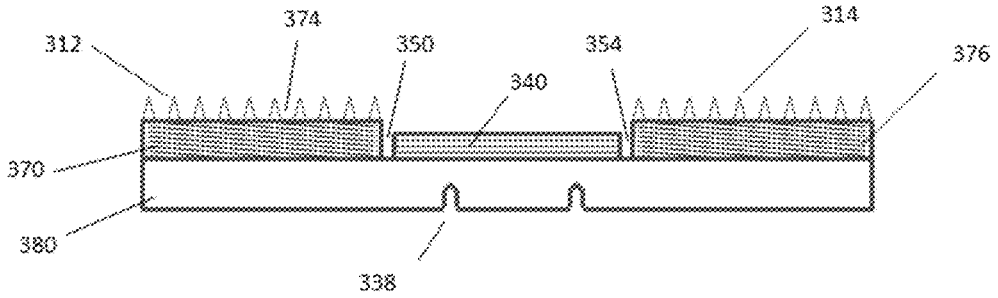
FIG. 2B is a portion of a completed CMP pad conditioning assembly (cross section).

FIG. 2A is a cross section illustration that shows how a CMP pad conditioning assembly can be made, and FIG. 2B illustrates a completed portion of a CMP pad conditioning assembly (cross section). The CMP pad conditioning assembly includes a backing plate 380 that has one or more mounting structures 338 that are used to attach or fix the backing plate 380 of the conditioning assembly to a CMP polishing tool (not shown). One or more abrasive segments or abrasive regions 370 can be fixed at a bottom face 378 of the abrasive segment to the top face 384 of the backing plate. The abrasive segment or region includes protrusions 312 on a top surface 374 of 370. The abrasive segment or abrasive region 370 has a top face 374 and one or more protrusions 312 that can be completely or partially coated with a wear resistant material like polycrystalline diamond. One or more supporting structures 340 can be fixed mechanically or with an adhesive by a bottom face 346 of the segment to the top face 384 of the backing plate. The top surface of the one or more supporting structures 340 can be an untreated or uncoated surface. Optionally, the top surface 344 of the one or more supporting structures can be treated, shaped, or coated to reduce wear or change the surface energy of either the support structure 340, the CMP pad, or a combination thereof. FIG. 2B shows a portion of an assembled CMP pad conditioning assembly that includes one or more channels 350 and 354 between a supporting structure 340 and adjacent abrasive regions 370 and 376.

Figure 3:
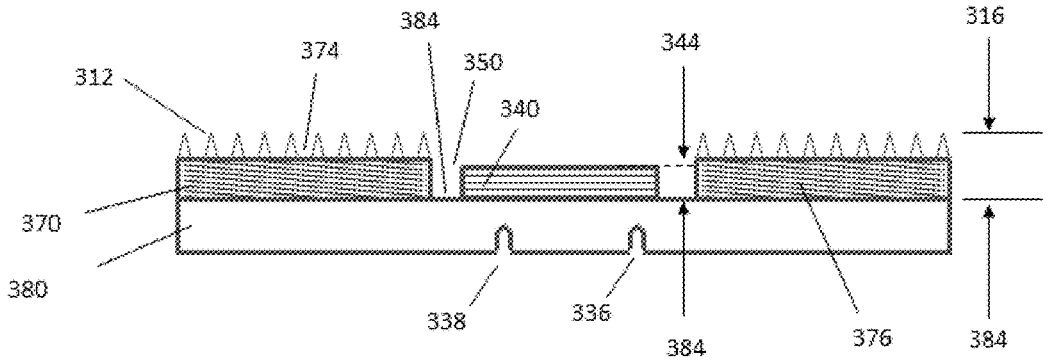
FIG. 3 is an illustration of a CMP pad conditioning assembly that shows the tops of the protrusions or cutting edges of an abrasive region, the top surface of a supporting structure, and the relative heights of these with respect to the first face of the backing plate.

FIG. 3 is an illustration of a CMP pad conditioning assembly that shows the first plane of the tops of an abrasive region 316 and the second plane of the top surface of the supporting structure 344 and the difference in their heights with respect to the first face 384 of the backing plate. A top of the protrusions or cutting edges 312 can have a first average height, for example the difference between the tops for the abrasive regions 316 and first face 384 of the backing plate 380. One or more supporting structures 340 can be fixed to the backing plate 380. The one or more supporting structures 340 can be positioned between, and can be separated from, the abrasive regions 370 by one or more channels 350. The one or more supporting structures 340 have a top surface 344, a bottom surface 346, and a thickness measured between the top and bottom surface. In the portion of the pad conditioning assembly illustrated in FIG. 3, the top surface 344 of the one or more supporting structures (340) resides in a second plane that has a second average height, for example the measured difference between 344 and 384. The first average height is greater than the second average height. In some versions the first average measured height is greater than the second average measured height by between 25 microns and 200 microns.

Figure 4:
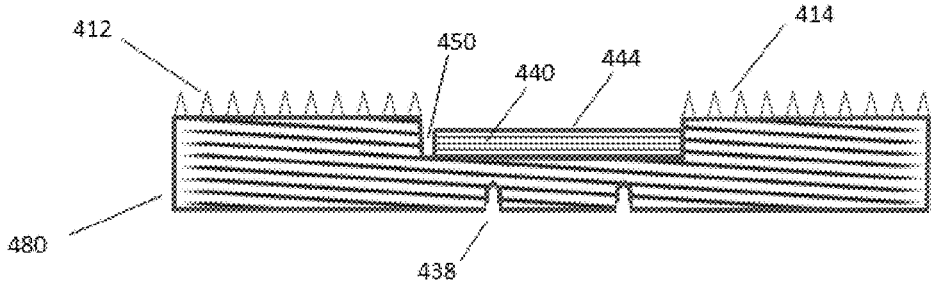
FIG. 4 is an illustration of a CMP pad conditioning assembly that has a channel between one abrasive region and a support structure and no channel between another abrasive region and the support structure. The abrasive regions are illustrated as having protrusions or cutting edges that can be formed integrally from the backing plate, although similar structures can be made with individual abrasive segments (not shown).

FIG. 4 is an illustration of a CMP pad conditioning assembly that has a channel 450 for CMP pad debris, slurry and liquid flow between one abrasive region with protrusions or cutting edges 412 and support structure 440 while there is no channel between another abrasive region with protrusions 414 and the support structure 440. The abrasive regions and optionally protrusions or cutting edges are illustrated as being formed integrally from the backing plate 480, however similar structures can be made with individual abrasive segments (not shown). The protrusions 412 and 414 can be coated with diamond grit and or polycrystalline diamond while the support structure 440 top surface 444 can be free of any abrasive coating or hard material.

Figure 5:
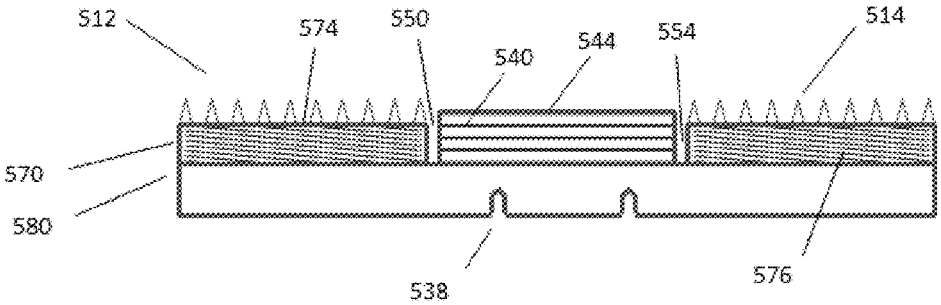
FIG. 5 is an illustration of a CMP pad conditioning assembly that has a supporting structure whose height measured from the top surface of the supporting structure to the first face of the backing plate is greater than the height of the abrasive segment top surface measured to the first face of the backing plate and where the height of the top surface of the supporting structure is less than the height of the tops of the average height of the protrusions or cutting edges on the abrasive segments. The abrasive regions are separated from the support by channels.

FIG. 5 is an illustration of a CMP pad conditioning assembly that has a supporting structure 540 whose height measured from the top surface 544 of the supporting structure 540 to the first face of the backing plate 580 is greater than the height of the abrasive segment top surface 574 measured to the first face of the backing plate and where the height of the top surface 544 of the supporting structure is less than the height of the tops of the average height of the protrusions or cutting edges 512 and 514 on the abrasive segments 570 and 576. Channels 550 and 554 are show lying between supporting structure 540 and abrasive regions 570 and 576.

FIG. 6 is an illustration of a CMP pad conditioning assembly that has a monolithic structure with support region (s) 640 with a top surface 644 that is separated by one or more channels 650 and 654 from abrasive regions with protrusions or cutting edges 612 and 614. This version of a CMP pad conditioning assembly can be made by machining a backing plate 680 that is for example ceramic material.

Figure 7:
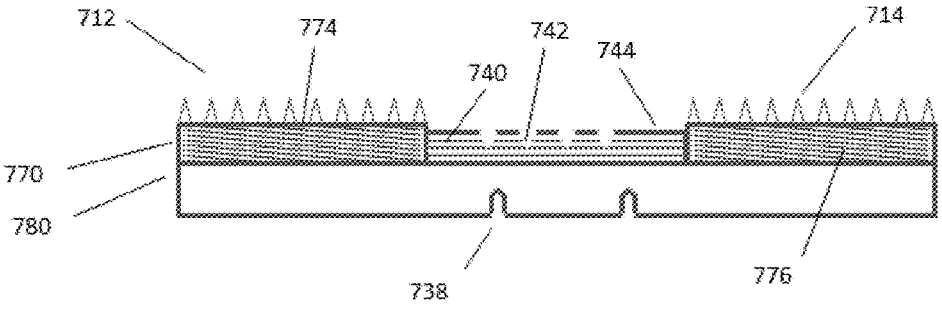
FIG. 7 is an illustration of a CMP pad conditioning assembly that has a supporting structure whose height measured from the top surface of the supporting structure to the first face of the backing plate is less than the height of the abrasive segment top surface measured to the first face of the backing plate.

FIG. 7 is an illustration of a CMP pad conditioning assembly that has a support structure 740 with channels 742 formed therein. The height measured from the top surface 744 of the supporting structure to the first face of the backing plate is less than the height of the abrasive segment top surface measured to the first face of the backing plate. FIG. 7 further illustrates that the abrasive regions are not separated from the support by channels and the support structure has channels in the top surface. The CMP pad conditioning assembly in FIG. 7 can be made by overmolding the support structure with channels 742 on a backing plate 780 with fixed abrasive regions 770 and 776.

The difference in height between the the tops of the protrusions or cutting edges and the top surface of the support structure is large enough that material removed from the CMP pad by the protrusions or cutting edges during pad conditioning is also removed from underneath the pad conditioning assembly while also providing tilt stability to the conditioning assembly when it is used on the outside edge of the CMP pad.

The top surface of the support structure is slightly recessed relative to the tops of the protrusion or cutting features. In the pad conditioning assembly, the first average height of the protrusions or cutting edges is greater than the second average height of the top surface of the support structure. In some versions of the pad conditioning assemblies, the top surface height or top average surface height of the support structure as measured from the top average surface of the backing plate is 25 microns to 200 microns below the average height of the tops of the protrusions or cutting edges. In other versions of the pad conditioning assemblies, the top surface height or top average surface height of the support structure as measured from the top average surface of the backing plate can be 50 microns to 100 microns below the tops of the average height of the protrusions or cutting edges. The supporting structures can include a top surface that is not co-planar with the top of the abrasive region(s).

The support structure can be positioned between abrasive segments or abrasive regions. Both the support structure and/or the abrasive segments or abrasive regions can be fixed, integrally cut or formed in the backing plate, or any combination of these. For example, FIG. 4 illustrates a conditioning assembly where the abrasive regions with protrusions 412 and 414 are integrally formed with the backing plate 480 and the supporting structure 440 is attached or fixed to the backing plate 480. FIG. 5 is an example of a conditioning assembly where the abrasive segments 570 and 576, with protrusions or cutting edges 512 and 514 respectively, are adhesively or mechanically fixed to the backing plate 580. FIG. 6 is an example of a conditioning assembly where the abrasive regions or abrasive segments with protrusions (or cutting edges) 612 and 614 and the conditioning segment 640 are integrally formed with the backing plate and separated by channels 650 and 654. In some versions the supporting structure is partially absent in the center of the conditioning pad as shown in FIG. 1B. Having the supporting structure in the center can further help to stabilize the conditioning assembly during use.

The form of the one or more supporting structure(s) and the form of the one or more abrasive segment(s) or abrasive region(s) is not limited to any particular geometry or shape. The shapes can be chosen to provide uniform conditioning of the underlying CMP pad and provide channels between the supporting structure(s) and abrasive segments or regions that allow flow of CMP pad debris, slurry, and liquid from between the CMP pad and the pad conditioning assembly. For example, FIG. 1A shows supporting segments that are in the shape of truncated pyramids, while FIG. 1B illustrates supporting segments that are in the shape of circular segments. The abrasive segments are generally illustrated as wedge shapes, however other shapes are possible. Other geometric and non-geometric shapes can be used for both the supporting structure(s) and abrasive region(s).

The support structure can have a thickness. In some versions the support structure thickness is in a range of 1900 microns to 6500 microns or the support thickness can be from about 1900 microns to about 6500 microns. In some other versions the support structure thickness is in a range of 1900 microns to 2500 microns or the support thickness can be from about 1900 microns to about 2500 microns. In addition to channels between abrasive segments or abrasive regions and supporting structures, the top surface of the supporting structure can have channels in its surface to further facilitate debris, slurry, and liquid flow from between the CMP pad and the pad conditioning assembly during use. These support structure surface channels can be formed in the supporting structure and can for example be straight or curved.

Regardless of the shape of the channels at any point along their length, the one or more channels can have a largest or maximum depth at any point as measured from the top surface of the one or more supporting structures to the top surface of the backing plate. In some versions f the pad conditioning assembly, that maximum depth of the channel at any point along its length can be 6500 microns or less. In some versions the one or more channels can have a largest or maximum depth as measured from the top surface of the one or more supporting structures to the bottom of the channel that is between 2500 microns to 500 microns or about 2500 microns to about 500 microns.

Similarly, the one or more channels such as 350 that can be characterized by a channel width along the length of the channel. The channels can have parallel or non-parallel walls. In some versions of the pad conditioning assembly, the channel width can have a largest dimension that is between 100 microns and 2500 microns or about 100 microns and about 2500 microns. In some other versions of the pad conditioning assembly the channel width can have a largest dimension that is between 1500 microns and 2500 microns or about 1500 microns and about 2500 microns.

In some versions of the pad conditioning assembly, a plurality of non-abrasive supporting structures can be spaced between the abrasive segments. In other versions, for example as shown in FIG. 6, the supporting structure can be a single unitary piece.

In some versions of the pad conditioning assembly, the channels for pad debris, slurry, and liquid flow can be formed between the abrasive regions and the support structures, can be formed in the support structure itself, or any combination of these. The channels can have a greatest depth from the top surface of the support structure, for example 344, down to the top surface of the backing plate 384. In some other versions, the depth of the channel can be less than 2500 microns, for example as shown by the channels 742 in FIG. 7, and may include versions absent any channel. The width of the channel at its widest provides flow of pad debris, slurry, and liquid away from the pad conditioning assembly during use and can be from 100 microns to 500 microns. Channels are not limited to rectangular shapes and can include curved, sloped, and triangular cross sections. Channels can have a combination of different depths and widths.

The channels can have non-parallel side walls that diverge in width from an inside diameter of the backing plate towards the outer diameter of the backing plate. In some versions of the channels have essentially parallel side walls. A combination of parallel and non-parallel channel side wall can also be used.

A mounting structure secures the backing plate to a chemical mechanical planarization tool. The mounting structure may include through holes or partial through holes in the backing plate that can be used to secure the pad conditioning assembly to the polishing tool with bolts and the like. FIG. 3 shows a non-limiting example of a mounting structure that includes partial through holes 336 and 338 that can optionally be threaded. The backing plate can be made of a metal, metal alloy, ceramic, or polymer.

The conditioner head of a CMP tool includes a CMP pad conditioning assembly that during the CMP process is brought into contact with the polishing pad. The CMP pad conditioning assembly is generally positioned at a bottom of the conditioner head and can rotate around an axis. The tops of the protrusions or cutting edges on the abrasive segment face down toward the CMP polishing pad and contact the surface of the CMP polishing pad during the conditioning process. During the pad conditioning and polishing process, both the polishing pad and the CMP pad conditioning assembly rotate so that these protrusions or cutting edges move relative to the surface of the polishing pad, thereby abrading and retexturizing the surface of the polishing pad. Versions of the CMP pad conditioning assembly can be swept to the outer diameter and in some versions beyond the outer diameter of the polishing pad without causing non-uniform/excess pad wear at the perimeter of the CMP pad.

After the CMP pad conditioning assembly illustrated in FIG. 1 and FIG. 3 has been used and the abrasive regions and or support structures worn, the abrasive regions and/or support structure can be removed from the backing plate and new or reconditioned abrasive regions and/or support structures fixed to the backing plate.

While various pad conditioning assemblies are described, it is to be understood that this disclosure is not limited to the particular molecules, compositions, designs, methodologies or protocols described, as these may vary. It is also to be understood that the terminology used in the description is for the purpose of describing the particular versions or embodiments only, and is not intended to limit the scope of the present disclosure which will be limited only by the appended claims.

It must also be noted that as used herein and in the appended claims, the singular forms "a", "an", and "the" include plural reference unless the context clearly dictates otherwise. Thus, for example, reference to an "supporting structure" is a reference to one or more supporting structures and equivalents thereof known to those skilled in the art, and so forth. Unless defined otherwise, all technical and scientific terms used herein have the same meanings as commonly understood by one of ordinary skill in the art. Methods and materials similar or equivalent to those described herein can be used in the practice or testing of embodiments of the present invention. All publications mentioned herein are incorporated by reference in their entirety. "Optional" or "optionally" means that the subsequently described event or circumstance may or may not occur, and that the description includes instances where the event occurs and instances where it does not. All numeric values herein can be modified by the term "about," whether or not explicitly indicated. The term "about" generally refers to a range of numbers that one of skill in the art would consider equivalent to the recited value (i.e., having the same function or result). In some embodiments the term "about" refers to ±10% of the stated value, in other embodiments the term "about" refers to ±2% of the stated value. While compositions and methods are described in terms of "comprising" various components or steps (interpreted as meaning "including, but not limited to"), the compositions and methods can also "consist essentially of" or "consist of" the various components and steps, such terminology should be interpreted as defining essentially closed or closed member groups. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

What is claimed is:

1. A CMP pad conditioning assembly comprising:

a backing plate that has a first face and a second face, said backing plate includes a mounting structure on the second face; said mounting structure secures the backing plate to a chemical mechanical planarization tool;

one or more abrasive regions on the first face of said backing plate that comprise one or more protrusions, tops of said protrusions reside in a first plane that has a first average height measured from the first face of the backing plate;

a single supporting structure on the first face of said backing plate and at least partially covering a central region of said backing plate, said single supporting structure comprising a plurality of supporting segments positioned between said abrasive regions and separated from said abrasive regions, said single supporting structure having a top surface, the top surface of said single supporting structure residing in a second plane that has a second average height measured from the first face of the backing plate, wherein the first average height of the first plane is greater than the second average height of the second plane; and one or more channels positioned between one or more of the supporting segments of the single supporting structure and the one or more abrasive regions, the one or more channels having a length and configured to allow flow of CMP pad debris, slurry or liquid away from the CMP pad conditioning assembly along its length.

2. The pad conditioning assembly of claim 1 wherein the plurality of supporting segments of the single supporting structure form the one or more channels with the one or more abrasive regions.

3. The pad conditioning assembly as in claim 1, that further comprises a coating of a hard polycrystalline material on all or a portion the abrasive regions.

4. The pad conditioning assembly as in claim 1, in which the first average height of the first plane is greater than the second average height of the second plane by between 25 microns and 200 microns.

5. The pad conditioning assembly of claim 1 where the one or more channels have a channel width with a largest dimension that is between 1500 microns and 2500 microns.

6. The pad conditioning assembly of claim 1, wherein the support structure is a polymeric material.

7. The pad conditioning assembly of claim 2 wherein the abrasive regions include protrusions or elongated cutting structures.

8. The pad conditioning assembly of claim 7 wherein the abrasive regions are one or more segments fixed to the backing plate.

9. The pad conditioning assembly of claim 8 further comprising a coating of a hard material atop the abrasive regions.

10. The pad conditioning assembly of claim 9 where the first average height of the first plane is greater than the second average height of the second plane by between 50 microns and 100 microns.

11. The pad conditioning assembly of claim 1, wherein the one or more channels have non-parallel sidewalls that diverge in width from an inner diameter of the backing plate towards an outer diameter of the backing plate.

12. The pad conditioning assembly of claim 1, wherein the single supporting structure completely covers the central region of said backing plate.

13. A CMP pad conditioning assembly comprising:

a backing plate that has a first face and a second face, said backing plate includes a mounting structure on the second face; said mounting structure secures the backing plate to a chemical mechanical planarization tool;

one or more abrasive regions on the first face of said backing plate that comprise one or more protrusions, tops of said protrusions reside in a first plane that has a first average height measured from the first face of the backing plate;

a single supporting structure on the first face of said backing plate and at least partially covering a central region of said backing plate, said single supporting structure comprising a plurality of supporting segments positioned between said abrasive regions and separated from said abrasive regions, said single supporting structure having a top surface, the top surface of said single supporting structure residing in a second plane that has a second average height measured from the first face of the backing plate, wherein the first average height of the first plane is greater than the second average height of the second plane; and one or more channels positioned between one or more of the supporting segments of the single supporting structure and the one or more abrasive regions, the one or more channels having parallel sidewalls configured to allow flow of CMP pad debris, slurry or liquid away from the CMP pad conditioning assembly.

* * * * *